US010716976B2

(12) United States Patent
Henrikson et al.

(10) Patent No.: US 10,716,976 B2
(45) Date of Patent: Jul. 21, 2020

(54) GOLF CLUB HEAD HAVING A DETACHED FACEPLATE

(71) Applicant: KARSTEN MANUFACTURING CORPORATION, Phoenix, AZ (US)

(72) Inventors: Erik M. Henrikson, Phoenix, AZ (US); Eric J. Morales, Laveen, AZ (US); Samuel Pendred, Denford (GB)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/176,120

(22) Filed: Oct. 31, 2018

(65) Prior Publication Data

US 2019/0060717 A1 Feb. 28, 2019

Related U.S. Application Data

(63) Continuation of application No. 15/593,683, filed on May 12, 2017, now Pat. No. 10,130,852.

(60) Provisional application No. 62/335,590, filed on May 12, 2016.

(51) Int. Cl.
*A63B 53/04* (2015.01)
*A63B 60/52* (2015.01)

(52) U.S. Cl.
CPC ..... *A63B 53/047* (2013.01); *A63B 60/52* (2015.10); *A63B 2053/0408* (2013.01); *A63B 2209/08* (2013.01)

(58) Field of Classification Search
CPC ..... A63B 53/047; A63B 53/04; A63B 60/52; A63B 2053/0408
See application file for complete search history.

(56) References Cited

U.S. PATENT DOCUMENTS

| | | | | | |
|---|---|---|---|---|---|
| 1,154,490 | A | * | 9/1915 | Davis | A63B 53/047 473/329 |
| 2,034,936 | A | | 3/1936 | Barnhart | |
| 4,123,056 | A | * | 10/1978 | Nakamatsu | A63B 53/0487 473/234 |
| 4,398,965 | A | | 8/1983 | Campau | |
| 4,523,759 | A | * | 6/1985 | Igarashi | A63B 53/04 473/346 |
| 5,282,625 | A | * | 2/1994 | Schmidt | A63B 53/04 473/350 |
| 5,692,972 | A | | 12/1997 | Langslet | |
| 6,042,486 | A | * | 3/2000 | Gallagher | A63B 53/0475 473/329 |
| 6,506,129 | B2 | | 1/2003 | Chen | |
| 9,044,653 | B2 | | 6/2015 | Wahl | |
| 9,216,324 | B2 | | 12/2015 | Shear | |
| 9,227,114 | B2 | | 1/2016 | Takechi | |
| 9,320,948 | B2 | | 4/2016 | Fossum | |
| 9,669,271 | B2 | | 6/2017 | Soracco | |

(Continued)

OTHER PUBLICATIONS

Hopley, M; Taylormade Rsi 1, Rsi 2, Rsi Tp Irons Review; http://golfalot.com/equipment-reviews/taylormade-rsi-1-2-tp-iron-review-3031.aspx.

(Continued)

*Primary Examiner* — Michael D Dennis

(57) ABSTRACT

A golf club head includes a body having a faceplate with a strike surface, a toe end opposite a heel end, a back end opposite the faceplate, and a sole opposite a top rail, the faceplate is connected to the sole and configured to pivot about the sole.

19 Claims, 10 Drawing Sheets

(56) References Cited

U.S. PATENT DOCUMENTS

| | | | | |
|---|---|---|---|---|
| 2003/0203764 | A1* | 10/2003 | Dabbs | A63B 53/04 473/291 |
| 2005/0272524 | A1 | 12/2005 | Oh | |
| 2006/0116218 | A1 | 6/2006 | Burnett et al. | |
| 2008/0051213 | A1 | 2/2008 | Blankenship et al. | |
| 2009/0023513 | A1 | 1/2009 | Shibata | |
| 2015/0072798 | A1 | 3/2015 | Stites et al. | |
| 2015/0343281 | A1 | 12/2015 | Ban | |
| 2016/0045794 | A1* | 2/2016 | Taylor | A63B 53/047 473/349 |

OTHER PUBLICATIONS

Covey, T; Speed Pocket Evolved—Advanced Face Design; http://www.mygolfspy.com/2015-taylormade-rsi-irons/.

Dusek, D; Adams Xtd Forged Irons; http://golfweek.com/news/2013/oct/14/adams-xtd-forged-irons/.

Mizuno Mp-25 3-pw Iron Set With Steel Shaft; http://www.golfgalaxy.com/f/golf.golf-club0shaft?acq=Golfsmith.

International Search Report and Written Opinion dated Sep. 12, 2017 for PCT Application No. PCT/US17/32369, filed May 12, 2017.

* cited by examiner

GOLF CLUB HEAD HAVING A DETACHED FACEPLATE

CROSS REFERENCE TO RELATED APPLICATION

This is a continuation of U.S. patent application Ser. No. 15/593,683, filed on May 12, 2017, and claims the benefit of U.S. Provisional Patent Application No. 62/335,590, filed on May 12, 2016, the contents of all of which are incorporated fully by reference herein.

FIELD OF THE INVENTION

The present disclosure relates to a golf club, and more specifically to a detached golf club faceplate that increases faceplate deflection and provides a more uniform faceplate deflection.

BACKGROUND

Golf clubs take various forms, for example a wood, a hybrid, an iron, a wedge, or a putter, and these clubs generally differ in head shape and design (e.g., the difference between a wood and an iron, etc.), club head material(s), shaft material(s), club length, and club loft.

Generally, during impact with a golf ball, a golf club faceplate undergoes a certain amount of deformation. More specifically, at impact with the golf ball, the faceplate deflects and then rebounds in a spring-like manner. This resulting "spring-effect" between the faceplate and the golf ball can be quantified by a Coefficient of Restitution (COR). A higher COR increases the kinetic energy that is transferred to the golf ball at impact, generally increasing golf ball speed and golf ball launch distance.

While golf clubs have a variety of designs to increase faceplate deflection, these designs also limit or restrict deflection (or bending) of the faceplate near the heel, near the toe, and/or near the sole where the faceplate attaches to the golf club body. Accordingly, there is a need to further increase golf club faceplate deflection, and to provide a more uniform deflection across the golf club faceplate during impact with a golf ball to further increase the launch angle, the spring-effect, and decrease the spin imparted on the ball.

DETAILED DESCRIPTION

Figure 1:
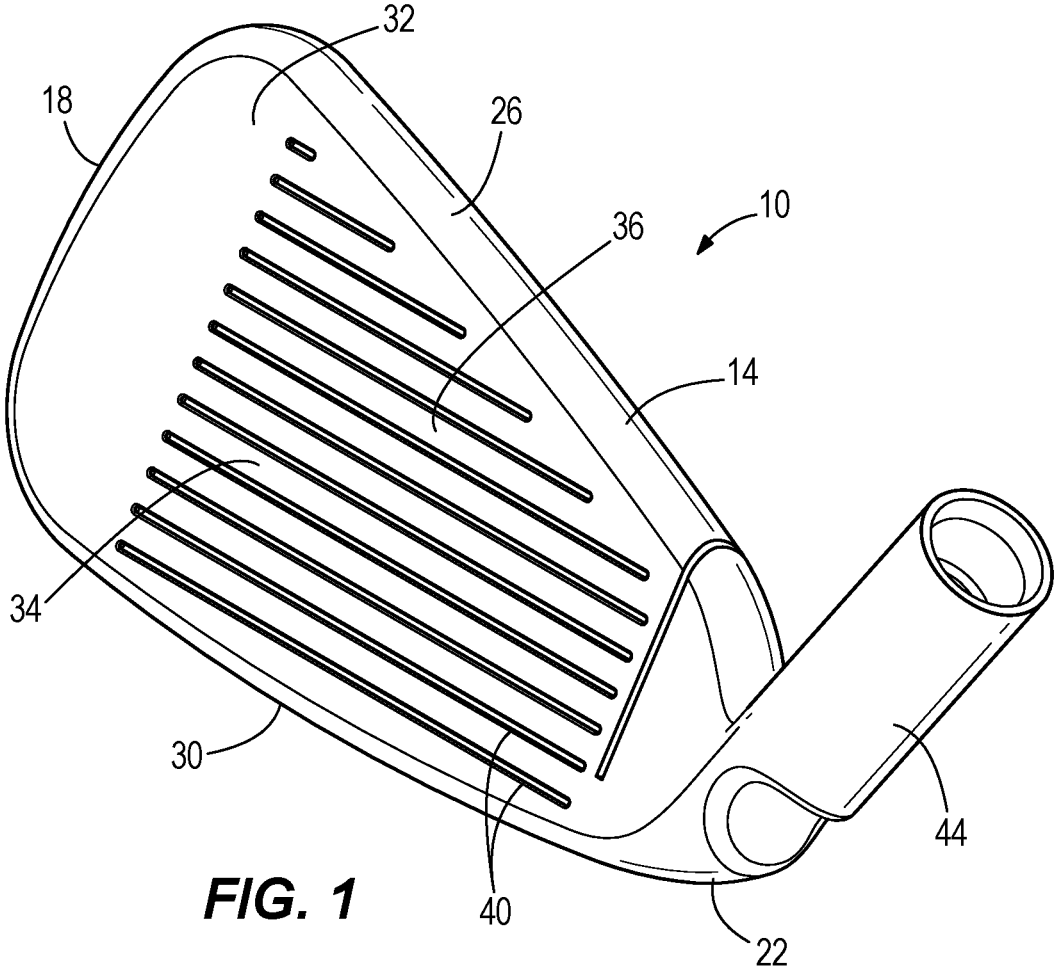
FIG. 1 is a perspective view of a golf club head that includes one or more embodiments of a detached faceplate as disclosed herein.

Disclosed herein is a golf club head having a slot that extends through the top rail to enable greater face deflection for higher launch angle and less spin for the golf ball flight. The golf club head having a body that includes a faceplate having a strike surface, a toe end, a heel end opposite the toe end, a back end opposite the faceplate, a sole extending between the faceplate and the back end, top rail connection the faceplate to the heel and toe ends of the body. The club head can further include at least one slot. The club head can have one, two, three or more slots. The slots of the golf club head extend through the top rail of the golf club head. For example, in one embodiment, the club head can include a first and a second slot. The first slot can extend entirely through the top rail into the toe end of the body, such that the faceplate is separated from the back end by the first slot in the toe end. The second slot can extend entirely through the top rail into faceplate 34, such that the faceplate is separated from the heel and back end of the body. In other embodiments, the second slot can extend entirely through the top rail into the heel end of the body, such that the faceplate is separated from the back end of the body. In some embodiments, the second slot can extend entirely through the top rail, but not into the heel end or the faceplate. In other embodiments, the second slot can extend partially into the top rail. In some embodiments, wherein the body comprises both the first and second slots, the faceplate can be separated from the back end on the toe and the heel ends of the body. In one embodiment, the golf club head is an iron type golf club head.

The presence of at least one slot that is cut at least through the top rail of an iron type club head results in greater deflection of the face plate, a higher launch angle, and a spin reduction. The at least one slot allows the faceplate to deflect a greater distance towards the back end of the club head than a faceplate of a club head not comprising the slots. The increased bending can be defined as cantilevered bending because the faceplate is only supported on one end at the sole. The increased cantilever bending can result in an increased ball launch angle and decrease in ball spin after impact. The increased ball launch angle and decrease in ball spin can result in the golf ball travelling a longer distance than a golf ball struck by a club head not comprising the slots.

The terms "loft" or "loft angle" of a golf club, as described herein, refers to the angle formed between the club face and the shaft, as measured by any suitable loft and lie machine.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

In addition, the detailed description references one or more embodiments of a "detached" golf club faceplate. The "detached" golf club faceplate describes a faceplate that is disconnected or separated from a portion of the club head. In the illustrated embodiments, one or more slots or gaps are formed or positioned between a portion of the faceplate (e.g., at a toe end and/or at a heel end of the faceplate) and a back end of the golf club to facilitate a greater and/or a more uniform deflection of the faceplate during impact with a golf ball. By increasing or providing a more uniform amount of deformation or deflection, the faceplate enhances the advantageous spring-like effect.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates a golf club head 10 as an iron. It should be appreciated that the iron is provided for purposes of illustration of one or more embodiments of a detached golf club faceplate, as disclosed herein. The disclosed embodiments of the detached golf club faceplate can be used on any desired iron, wood, hybrid, or other golf club where the faceplate deforms or deflects during golf ball impact. For example, the club head 10 may include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter. In addition, the golf club head 10 can have a loft that can range from approximately 3 degrees to approximately 65 degrees (including, but not limited to, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 50.5, 51, 51.5, 52, 52.5, 53, 53.5, 54, 54.5, 55, 55.5, 56, 56.5, 57, 57.5, 58, 58.5, 59, 59.5, 60, 60.5, 61. 61.5, 62, 62.5, 63, 63.5, 64, 64.5, and/or 65 degrees).

Golf Club Head

The embodiments described below are directed to a golf club head having at least one slot through a portion of the top rail of a golf club head. The golf club head can be an iron-type golf club head. Referring now to the figures, FIGS. 1-4 illustrate a golf club head 10 that incorporates one or more embodiments of the detached golf club faceplate.

The golf club head 10 includes a body 14 having a toe or toe end 18 opposite a heel or heel end 22. The body 14 also includes a top rail or top line or top 26 opposite a sole or bottom 30. The body 14 carries a club face 32 that includes a faceplate or strike plate 34 that defines a strike surface 36 (shown in FIGS. 1-2 and 4) and is opposite a rear end or back or rear or back side 38 (shown in FIGS. 3-4). A plurality of grooves 40 (shown in FIGS. 1, 2, and 4) are positioned on the faceplate 34. The golf club head 10 also includes a hosel 44 having a hosel axis 48 (shown in FIG. 2) that extends through a center of the hosel 44. The hosel 44 is configured to receive a golf club shaft (not shown) that carries a grip (not shown).

Figure 2:
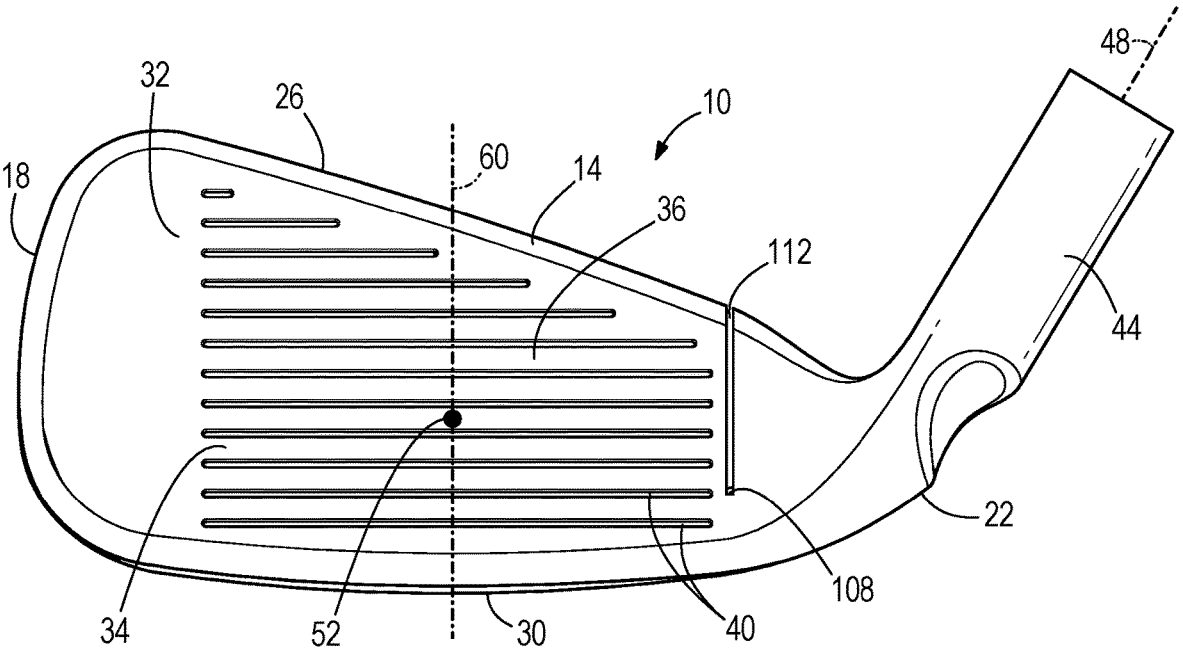
FIG. 2 is a front view of the club head of FIG. 1, illustrating the faceplate.
Figure 3:
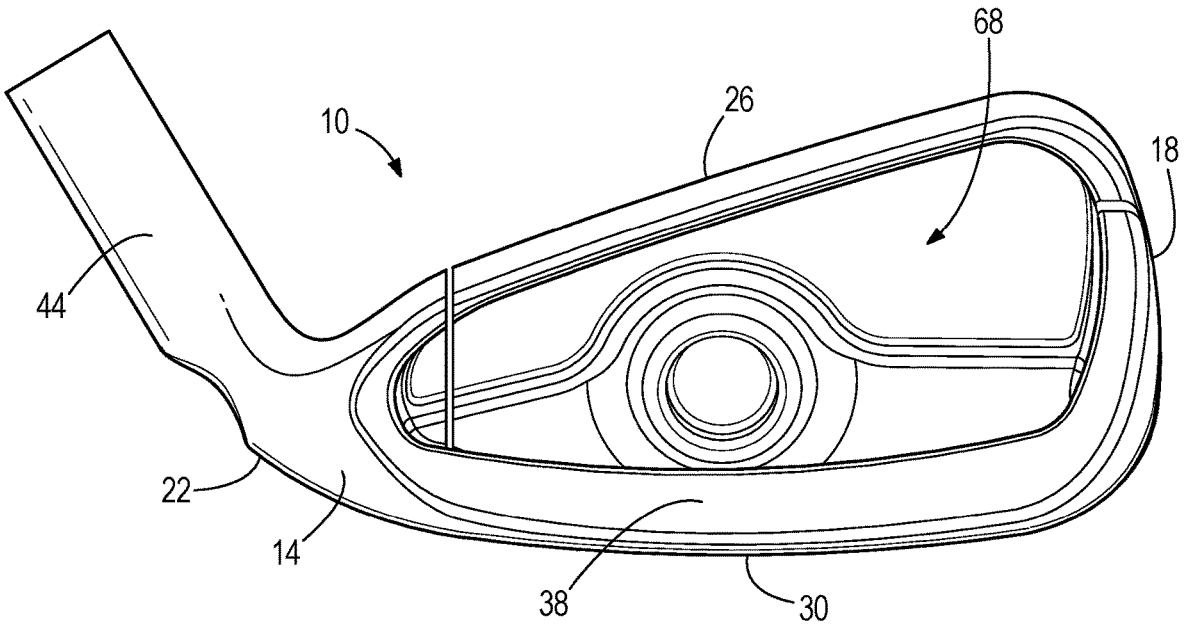
FIG. 3 is a rear view of the club head of FIG. 1, opposite the view of FIG. 2.
Figure 4:
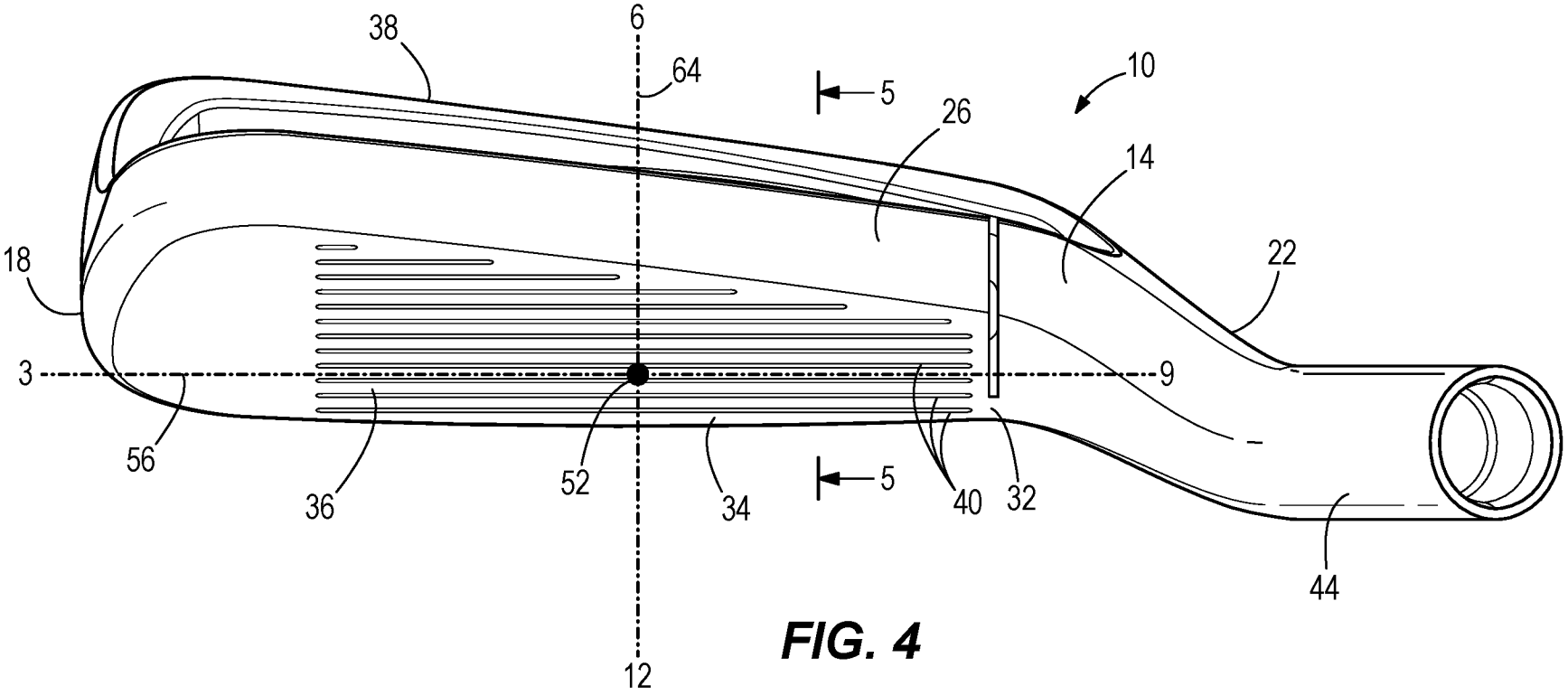
FIG. 4 is a top view of the club head of FIG. 1.

Referring now to FIGS. 2 and 4, the golf club head 10 includes a center of gravity or CG 52 that defines an origin of a coordinate system including an x-axis 56, a y-axis 60, and a z-axis 64. The x-axis 56 (shown in FIG. 4) extends through the club head 10 center of gravity 52 from the toe end 18 to the heel end 22. The y-axis 60 (shown in FIG. 2) extends through the club head 10 center of gravity 52 from the top 26 to the sole 30. The z-axis 64 (shown in FIG. 4) extends through the center of gravity 52 of the club head 10 from the faceplate 34 to the back 38. For additional guidance in describing the innovation herein, the x-axis 56 and the z-axis 64 are arranged to coincide with numbers on an analog clock in FIG. 4. The z-axis 64 extends between 12 o'clock ("12" through the faceplate 34) and 6 o'clock ("6" through the back 38), and the x-axis 56 extends between 3 o'clock ("3" through the toe end 18) and 9 o'clock ("9" through the heel end 22).

Figure 5:
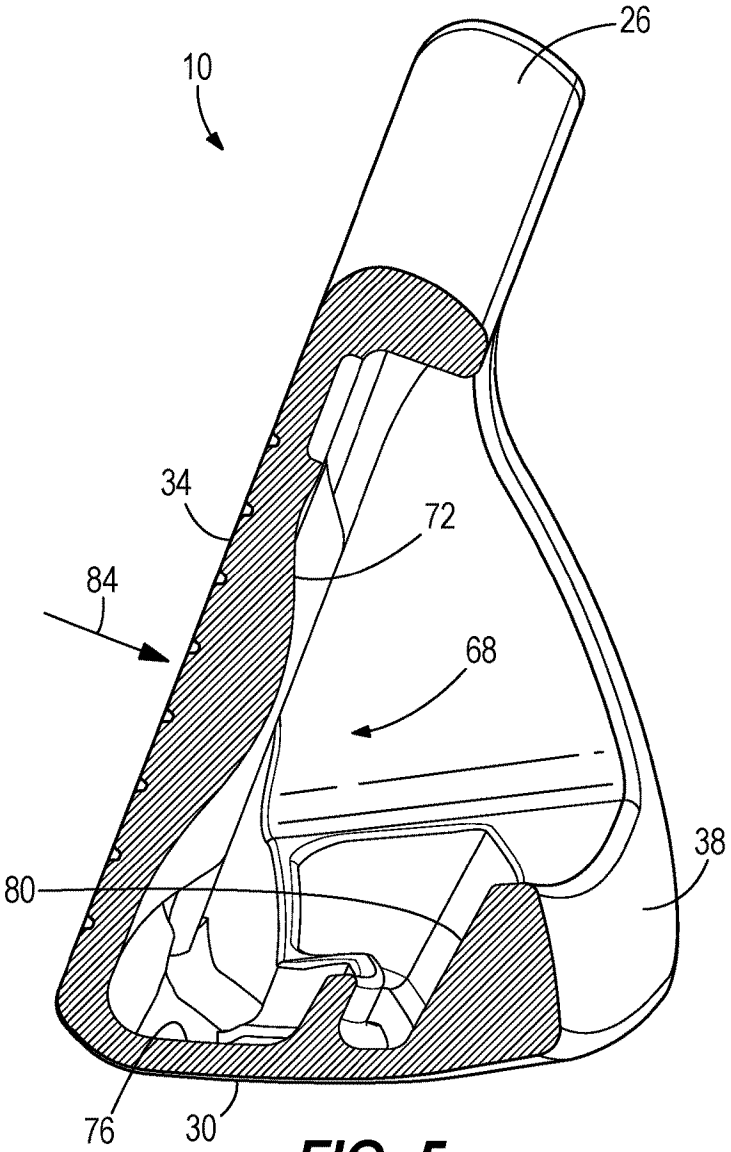
FIG. 5 is a cross-sectional view of the club head of FIG. 1, taken along line 5-5 of FIG. 4.

Referring now to FIG. 5, the golf club head 10 defines a cavity 68 that is formed between the faceplate 34 and the back 38. More specifically, the cavity 68 is partially formed by a back surface or first interior surface 72 of the faceplate 34, by an interior surface or upper surface 76 of the sole 30, and by a front or front surface or front side or interior surface 80 of the back 38.

During impact with the golf ball, the faceplate 34 deforms or deflects, in an approximate travel direction 84 (shown in FIG. 5) from the faceplate 34 towards the back 38. In known golf clubs, deflection of the faceplate 34 in the direction 84 can be limited by the faceplate 34 being connected to (and effectively restrained by) the sole 30, or to the back 38 at the toe 18 and/or the heel 22. To increase the deflection of the faceplate 34 in the direction 84, and/or to make the deflection of the faceplate 34 in the direction 84 more uniform, the faceplate 34 can be detached from the back 38 by a slot defining a gap.

The embodiments of the detached golf club head 10 can include one, two, three, four, five, six or more slots. The slots can be positioned on the toe end or the heel end of the body. Further, in some embodiments, the slots can extend entirely through the top rail and entirely or at least partially through the faceplate. In other embodiments, the slots can extend entirely through the top rail and entirely or at least partially through the toe or heel ends. In other embodiments, the slots can extend entirely through the top rail and not into the faceplate, the heel or the toe ends. In other embodiments, the slots can extend only partially into the top rail.

Each slot defines a gap having a width measured as the distance across the slot. In some embodiments, the width of the gap can remain constant or uniform across the length of the slot. In other embodiments, the gap can have a variable width along the length of the slot. For example, the gap can have a tapered width (e.g., an increasing width along the length of the slot in a direction from the sole 30 towards the top rail 26, or a decreasing width along the length of the slot in a direction from the sole 30 towards the top rail 26) or a non-uniform width (e.g., the width can both increase and decrease along the length of the slot in a direction from the sole 30 towards the top rail 26).

Detaching the faceplate 34 from the back end 38 via the first and second slots the faceplate 34 is free to deflect about the sole 30 without being restrained by the heel or toe ends as discussed above. Because the faceplate 34 is not restrained by the heel or toe ends, at the point of impact the faceplate 34 can experience greater deflection about the sole. The increase in bending about the sole 30 can be defined as cantilevered bending, as the faceplate 34 is connected by a single end at the sole 30. The increased cantilever bending can result in an increased ball launch angle and decrease in ball spin after impact. The increased ball launch angle and decrease in ball spin can result in the golf ball travelling a longer distance than a golf ball struck by a club head not comprising the slots.

Further, because the faceplate 34 is not constrained by the heel or the toe ends, less drum style bending (bending in the center with respect to the perimeter of the faceplate 34) occurs. A reduction in the drum style bending relieves stress from the faceplate 34 at the point of impact. This reduction in stress allows for the faceplate 34 to be thinner than a golf club head not comprising the first and second slots. Having a thinner faceplate 34 reduces the weight of the faceplate 34 and allows for the extra discretionary weight to be reintroduced to areas of the club head improving the club head CG location and club head MOI.

While the embodiments described above and throughout the remainder of the disclosure illustrate the golf club head 10 including two slots (the first and second slots, on the toe and heel end), in other embodiments the golf club head 10 can include one slot. For example, in other embodiments, the club head 10 can include just the first slot (toe slot) or just the second slot (heel slot).

First (Toe) Slots

Figure 6:
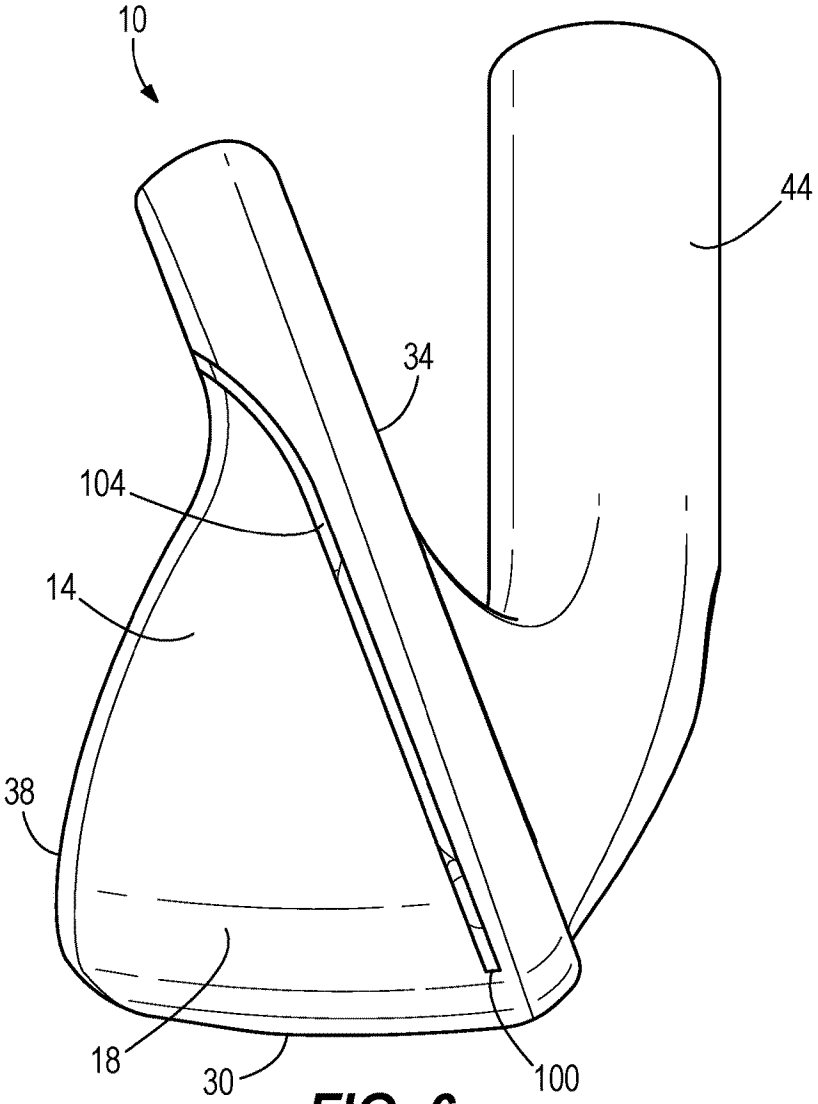
FIG. 6 is an end view of the club head of FIG. 1, illustrating a first slot through the toe end.
Figure 7:
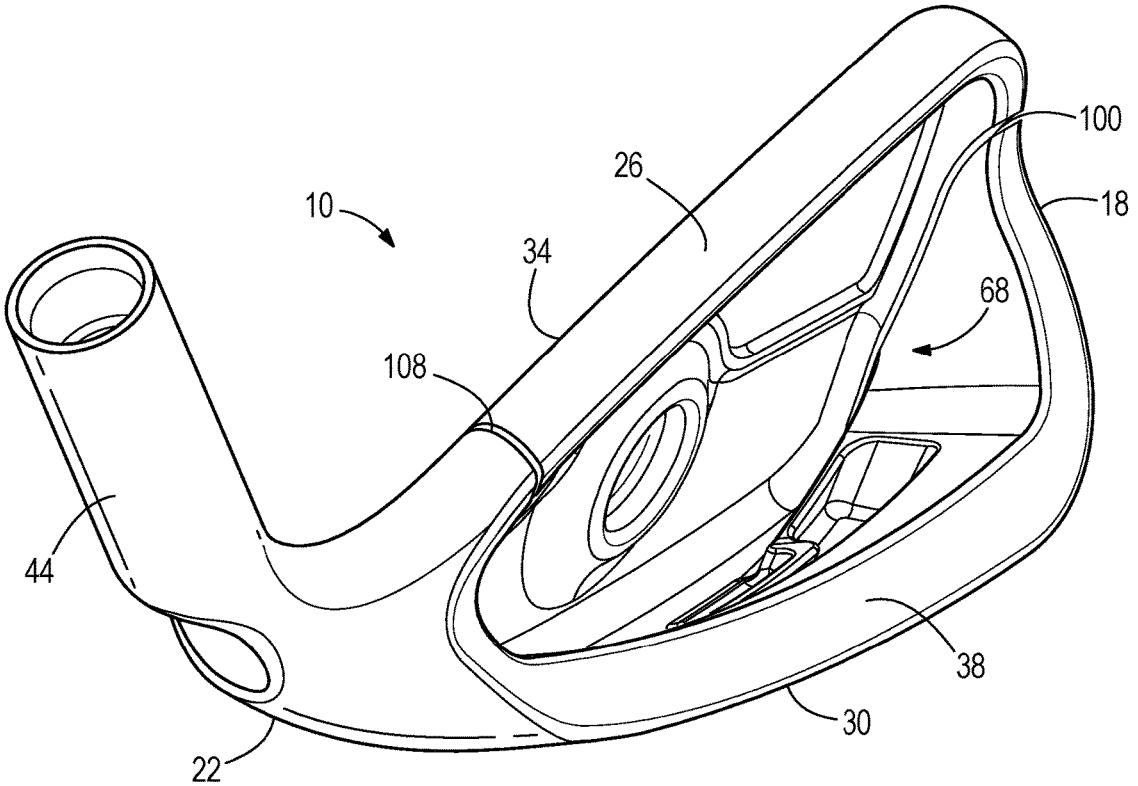
FIG. 7 is a perspective view of the rear of the club head of FIG. 1, illustrating the first slot through the toe end.

Referring to FIGS. 6 and 7, a first slot or channel or notch 100 is formed between the faceplate 34 and the back 38 at the toe 18 (or at the toe end of the faceplate 34. The first slot 100 defines a gap 104 between the faceplate 34 and the back 38. In the illustrated embodiment, the first slot 100 extends entirely through the top rail 26 and into the toe 18 towards the sole 30; such that the gap 104 separates the faceplate 34 from the back end 38. In other embodiments, the first slot 100 can extend entirely through the top rail 26 and into the faceplate 34 towards the sole 30, wherein the gap 104 separates the faceplate 34 from the toe end 18 of the body 14. In other embodiments, the slot 100 extends entirely through the top rail 26 and not into the toe 18 or the faceplate 30, such that the gap 104 separates the top rail 26 from the toe 18. In other embodiments, the slot 100 can extend only partially into the top rail 26. Further, in embodiments wherein the slot 100 extends into the toe 18 or the faceplate 34, the slot 100 can extend up to 100% of the height (measured as the distance from the sole 30 to top rail 26) of either the toe 18, or of the faceplate 34. For example, in some embodiments, the slot 100 can extend up to 100%, 90%, 80%, 70%, 60%, 50%, 40%, 30%, 20%, or 10% of the height of either the toe 18 or the faceplate 34. Stated another way, a first slot 100 is positioned through a portion of an outer perimeter or an outer surface of the body 14. The outer perimeter (or the outer surface) of the body 14 is defined, in total, by the toe 18, the top rail 26, the heel 22, and the sole 30. The gap 104 of the first slot 100 can extend entirely or at least partially through the top rail 26 such that the first slot 100 is open at (or near) the top rail 26. As shown in FIG. 6, the first slot 100 extends through the outer perimeter (or outer surface) of the body 14 at the toe 18. In addition, as shown in FIG. 7, the first slot 100 extends through the body 14 from the toe 18 into the cavity 68. The first slot 100 separates the faceplate 34 from the back 38 at the toe 18, such that at (or proximate) the toe end 18 the faceplate 34 is connected to the back 38 only by the sole 30.

Referring again to FIGS. 6 and 7, the gap 104 of the slot 100 comprises a width, measured as the distance across the first slot 100. In the illustrated embodiment, the width of the gap 104 remains constant or is uniform along its entire length. However, in other embodiments, the gap 104 can have a variable width along the length of the slot 100. For example, the gap 104 can have a tapered width (e.g., an increasing width along the length of the slot 100 in a direction from the sole 30 towards the top rail 26, or a decreasing width along the length of the slot 100 in a direction from the sole 30 towards the top rail 26) or a non-uniform width (e.g., the width can both increase and decrease along the length of the slot 100 in a direction from the sole 30 towards the top rail 26).

Figure 9:
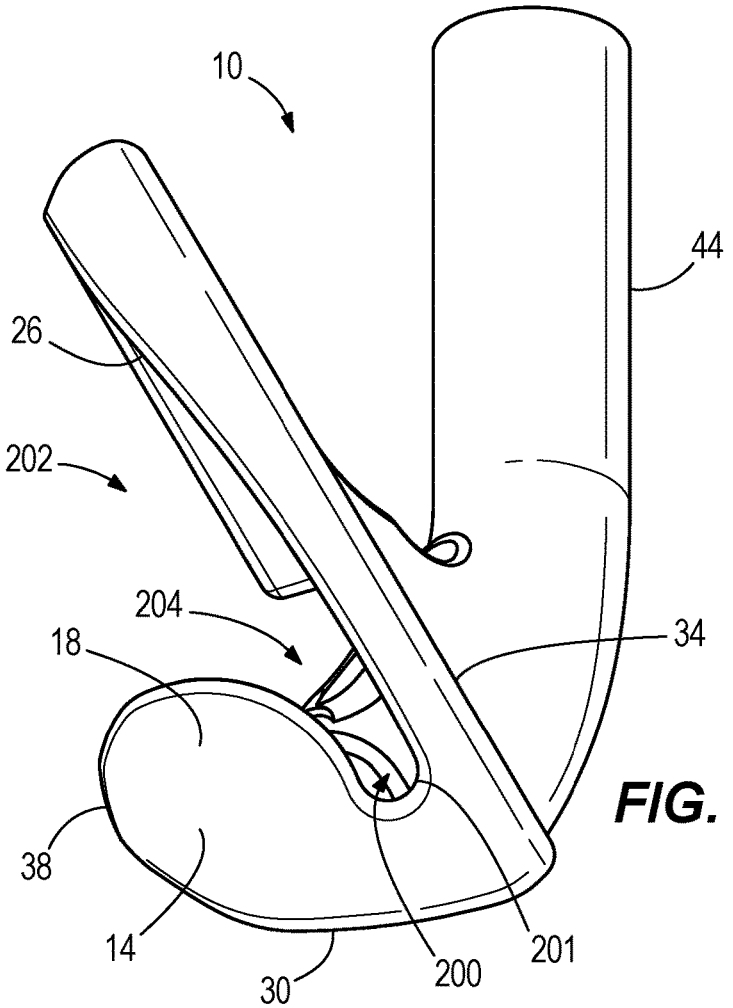
FIG. 9 is a toe side view of another embodiment of a first slot through the toe end.
Figure 10:
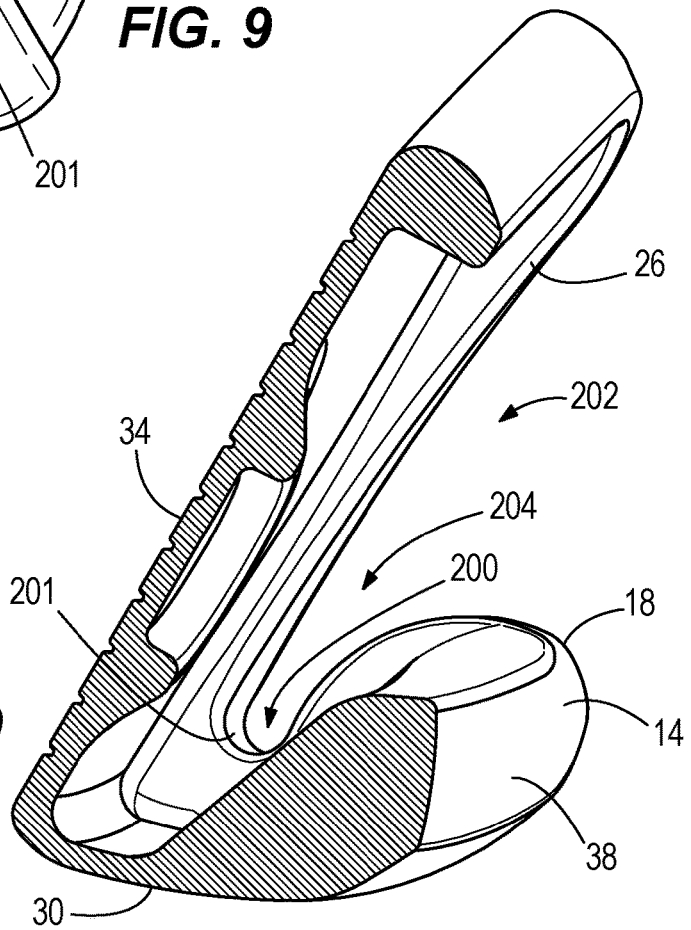
FIG. 10 is a cross-sectional view from the heel side of the first slot of FIG. 9.

Turning now to FIGS. 9 and 10, another embodiment of the golf club head 10 comprising a first slot 200 having a gap 204 of increasing width is shown. The first slot 200 is similar to the first slot 100 in that it extends entirely through the top rail 26 into the toe 18 towards the sole 20, such that the gap 204 separates the faceplate 34 from the back 38 at the toe end 18 of the body 14. However, the gap 204 of the first slot 200 has a varying width. The gap 204 increases in a curvilinear manner along the length of the first slot 200 in a direction from the sole 30 to the top rail 26. The first slot 200 comprises a first end 201 positioned nearest the sole 30 of the club head 10 and a second end 202 which extends entirely through the top rail 26. In the illustrated embodiment, the gap 204 has a smallest width of 0.4 inches at the first end 201, and a largest width of 0.75 inches at the second end 202. Therefore, when viewed from a toe-side view it appears as though a portion of the toe 18 is void from the body 14. As such, the faceplate 34 can bend a greater distance without being constrained by the toe portion 18 or the back 38 of the body 14. Further, the first end 201 of the first slot 200 nearest the sole 30 comprises a radius to help distribute stress concentrations experienced during the bending of the faceplate 34. In the illustrated embodiment, the radius of the first end 201 of the first slot 200 near the sole 30 is 0.15 inches.

Figure 13:
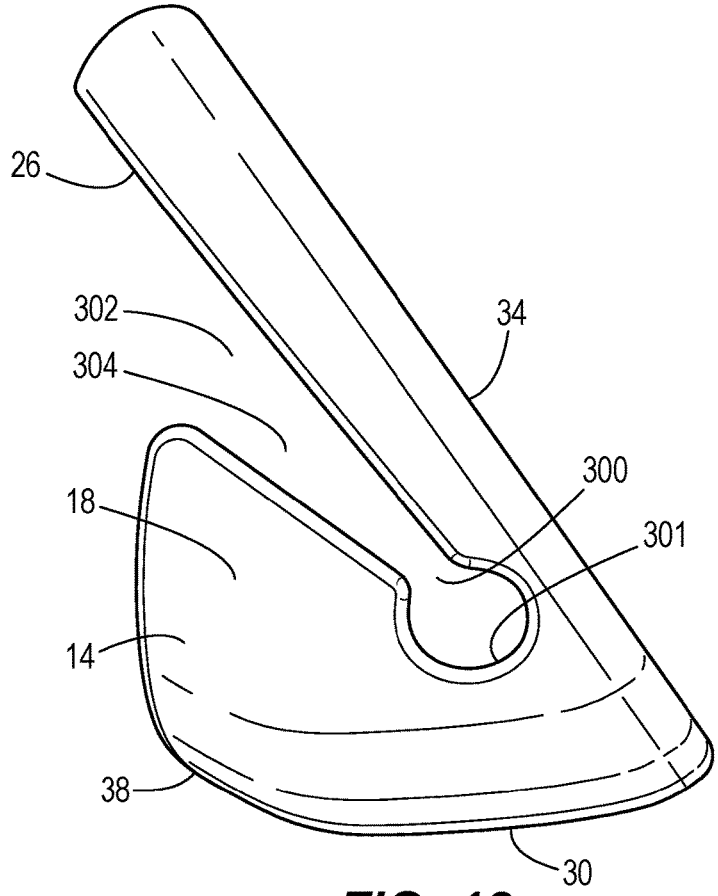
FIG. 13 is a toe side view of another embodiment of a first slot through the toe end.

Turning now to FIG. 13, an embodiment of the golf club head 10 comprising a first slot 300 having a gap 304 of increasing width is shown. The first slot 300 is similar to the first slots 100, 200 in that it extends entirely through the top rail 26 into the toe 18 towards the sole 20, such that the gap 204 separates the faceplate 34 from the back 38 at the toe end 18 of the body 14. However, the gap 304 of the first slot 300 comprises a circular first end 301 and a linearly increasing width from the first end 301 towards the second end 302 (in a direction from the sole 30 towards the top rail 26). In the illustrated embodiment, the first end 301 has a radius of 0.125 inches. In other embodiments, the radius of the first end 201, 301 can have a radius of between 0.05 to 0.3 inches. For example, in some embodiments, the first end 201, 301 can have a radius of between 0.05 to 0.1 inches, 0.075 to 0.125, 0.1 to 0.15, 0.125 to 0.175, 0.15 to 0.20, 0.175 to 0.225, 0.20 to 0.25, 0.225 to 0.275, or 0.250 to 0.30 inches.

Further, the width of the gap 104, 204, 304 can range from approximately 0.02 inches to approximately 2.0 inches. In other embodiments the width of each gap 104, 204, 304 can range from approximately 0.020 inches to approximately 0.120 inches, from approximately 0.040 inches to approximately 0.100 inches, 0.080 inches to approximately 0.100 inches, from approximately 0.080 inches to approximately 0.15 inches, from approximately 0.100 inches to approximately 0.35 inches, from approximately 0.20 inches to approximately 0.45 inches, from approximately 0.30 inches to approximately 0.55 inches, from approximately 0.40 inches to approximately 0.65 inches, from approximately 0.50 inches to approximately 0.75 inches, from approximately 0.60 inches to approximately 0.85 inches, from approximately 0.070 inches to approximately 0.95 inches, from approximately 0.080 inches to approximately 1.05 inches, from approximately 0.090 inches to approximately 1.15 inches, from approximately 1.00 inches to approximately 1.250 inches, from approximately 1.10 inches to approximately 1.35 inches, from approximately 1.20 inches to approximately 1.45 inches, from approximately 1.30 inches to approximately 1.55 inches, from approximately 1.4 inches to approximately 1.75 inches, from approximately 1.60 inches to approximately 1.85 inches, or from approximately 1.750 inches to approximately 2.0 inches. In many embodiments, the width of each gap 104, 204, 304 can be greater than or equal to 0.040 inches. In addition, the gaps 104, 112 can have a width that is 0.020 inches, 0.030 inches, 0.040 inches, 0.050 inches, 0.060 inches, 0.070 inches, 0.080 inches, 0.090 inches, 0.100 inches, 0.110 inches, 0.120 inches, 0.150 inches, 0.170 inches, 0.200 inches, 0.250 inches, 0.300 inches, 0.350 inches, 0.400 inches, 0.450 inches, 0.500 inches, 0.550 inches, 0.600 inches, 0.650 inches, 0.700 inches, 0.750 inches, 0.800 inches, 0.850 inches, 0.900 inches, 1.000 inches, 1.100 inches, 1.120 inches, 1.130 inches, 1.140 inches, 1.150 inches, 1.160 inches, 1.170 inches, 1.180 inches, 1.190 inches, or 2.000 inches. In various embodiments, the gaps 104, 204, 304 can have the same width or different widths.

In another example of an embodiment, the first slot 100 can separate the faceplate 34 from the back 38 along a portion of the body 14 at the toe 18. More specifically, at the toe 18, the faceplate 34 can be connected to the back 38 by the sole 30, and at an interface between the back 38 and the faceplate 34 spaced from the sole 30, with the first slot 100 extending there between. The first slot 100 is positioned through a portion of the outer perimeter (or the outer surface) of the body 14 at the toe 18, and further is open (or the gap 104 is present) at the top rail 26.

Second (Heel) Slots

Figure 8:
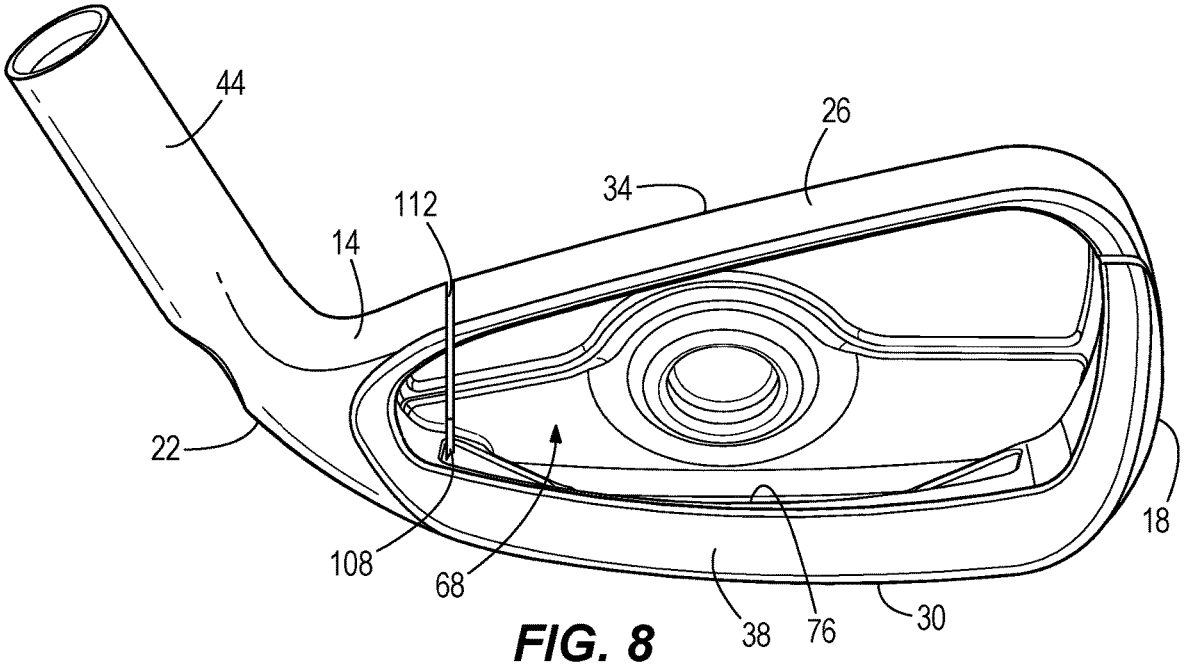
FIG. 8 is another perspective view of the rear of the club head of FIG. 1, illustrating a second slot through a portion of the faceplate proximate the heel.
Figure 11:
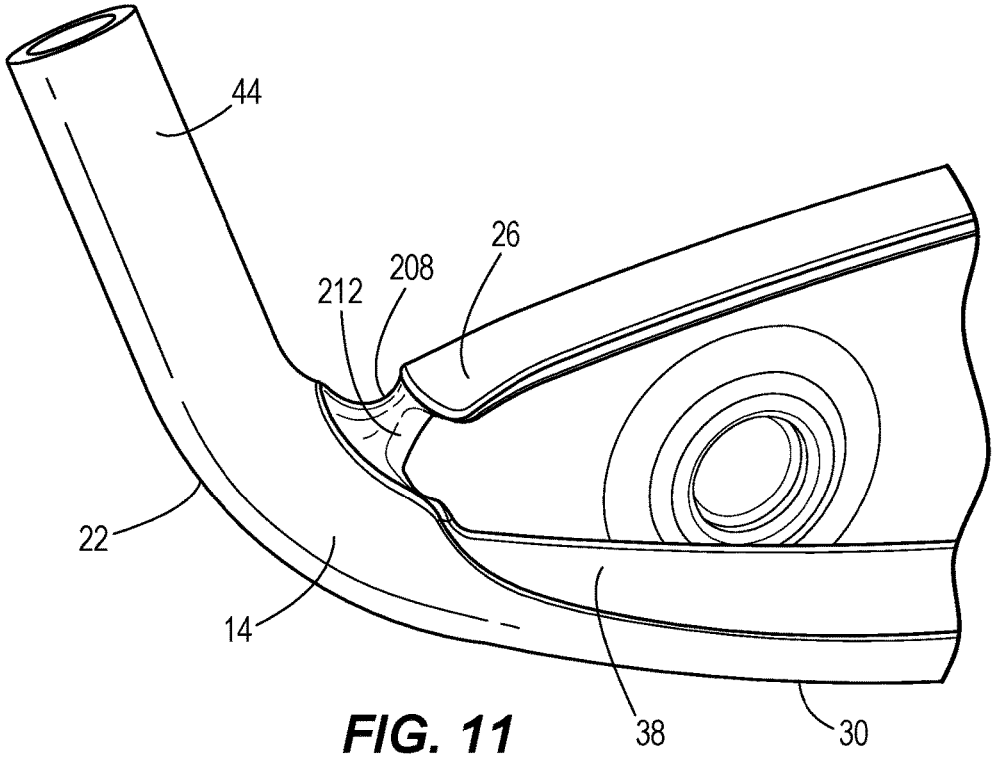
FIG. 11 is a rear view of another embodiment of a second slot through the heel end.
Figure 12:
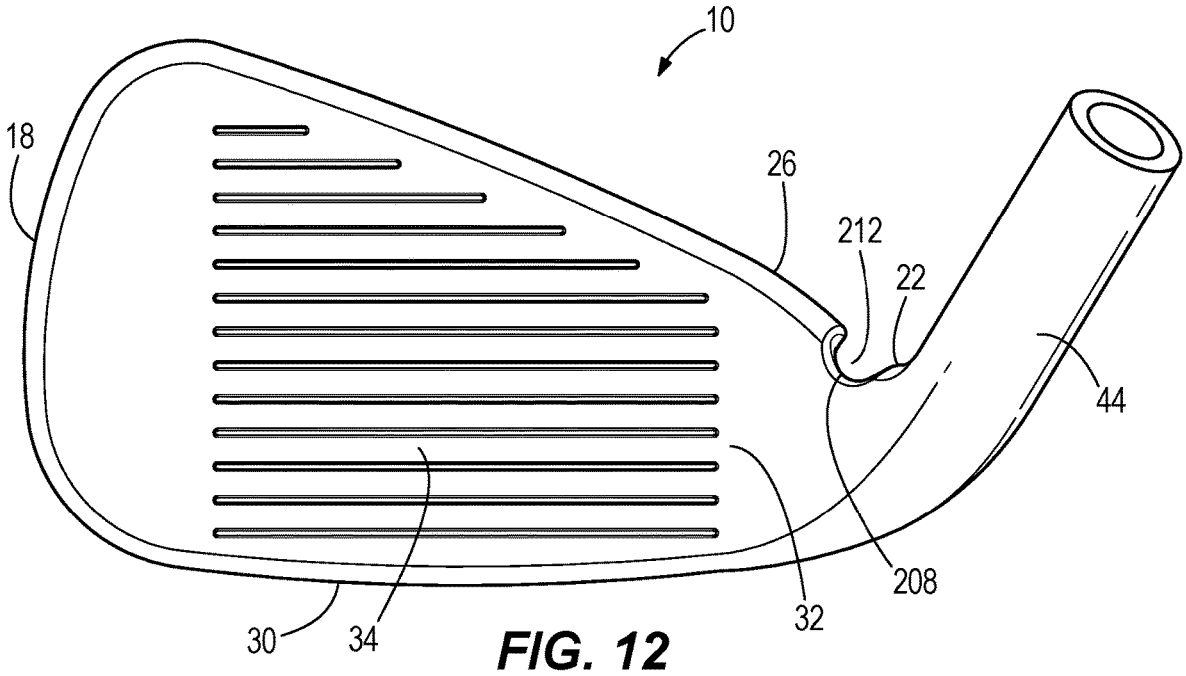
FIG. 12 is a front view of the second slot of FIG. 11.
Figure 17:
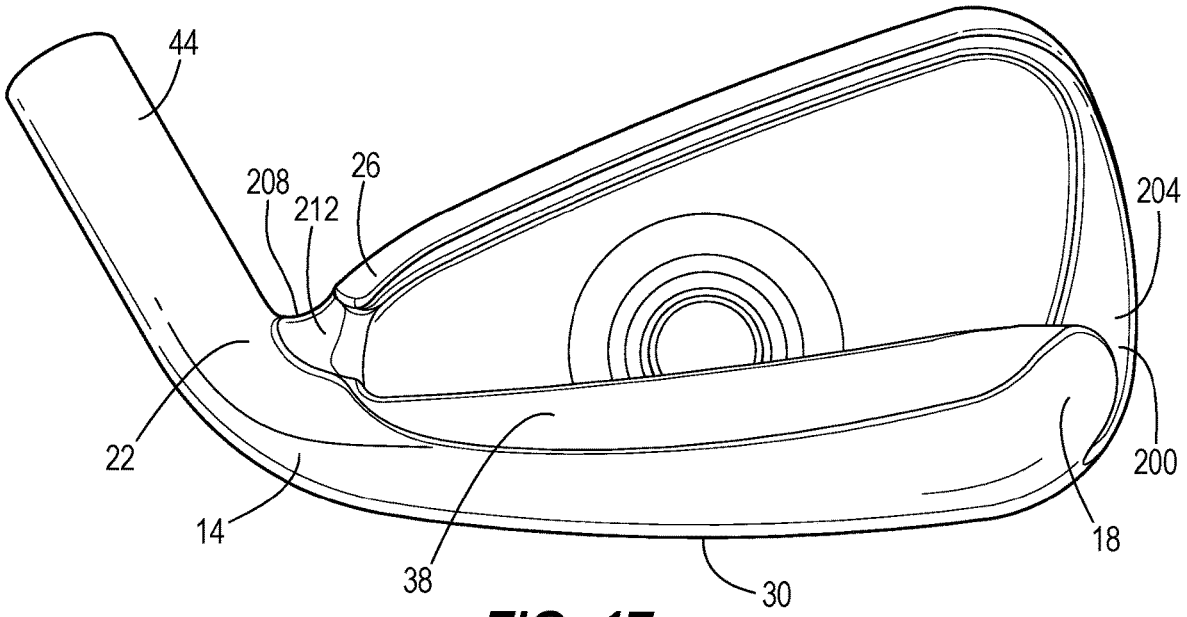
FIG. 17 is a rear perspective view of another embodiment of the club head comprising a first and second slot.

Referring to FIGS. 2 and 8, a second slot or channel or notch 108 is formed between the faceplate 34 and the back 38 proximate the heel 22 (or near the heel end of the faceplate 34). The second slot 108 defines a gap 112 between the faceplate 34 and a heel end 22 of the body 14. In the illustrated embodiment, the second slot 108 extends entirely through the top rail 26 and into at least a portion of the faceplate 34 towards the sole 30, wherein the gap 112 separates the faceplate 34 from the heel end 22 and the back end 38 of the body 14. In other embodiments, the second slot 108 extends entirely through the top rail 26 and into at least a portion of the heel end 22 towards the sole 30, such that the gap 112 separates the faceplate 34 from the back end 38 of the body 14. In other embodiments, the second slot 208 can extend entirely through the heel portion 22 and at least partially into the hosel portion 44. In these or other embodiments, the slot 208 can serve to detach the faceplate 34 from the heel portion 22, as well as create a bending point on the hosel 44 allowing for loft and lie adjustments. In other embodiments, the second slot 108 can extend only through the top rail 26 (FIG. 11), such that the gap 112 separates the top rail 26 from the heel end 22. In other embodiments, the second slot 108 can extend only partially into the top rail 26 (FIG. 17). Further, in embodiments wherein the second slot 108 extends into the heel 22 or the faceplate 34, the second slot 108 can extend up to 100% of the height (measured as the distance from the sole 30 to the top rail 26) of either the heel 22, or of the faceplate 34. For example, in some embodiments, the second slot 100 can extend up to 100%, 90%, 80%, 70%, 60%, 50%, 40%, 30%, 20%, or 10% of the height of either the heel 22 or the faceplate 34. The second slot 108 can also extend through the body 14 and into communication with the cavity 68 (shown in FIG. 8). Stated another way, a second slot 108 is positioned through a portion of an outer perimeter (or an outer surface) of the body 14. The outer perimeter (or the outer surface) of the body 14 is defined, in total, by the toe 18, the top rail 26, the heel 22, and the sole 30. The gap 112 of the second slot 108 passes through a portion of the top rail 26, and further is open at the top rail 26. As shown in FIG. 2, the second slot 108 extends approximately perpendicular to the grooves 40. However, in other embodiments, the second slot 108 can be positioned at any orientation in relation to the grooves 40. Turning now to FIGS. 11 and 12, an embodiment of the golf club head 10 having a second slot 208 extending only through the top rail 26 is illustrated. The slot 208 includes a gap 212 separating the top rail 26 from the heel end 22 of the body 14. In other embodiments, referring to FIG. 17, the second slot 208 can extend partially through the top rail 26. Removing the connection between the top rail 26 and the heel side 22 of the body 14 can allow for the faceplate 34 to bend without being constrained by the heel side 22 of the body 44. As such, the faceplate 34 is free to bend about the sole 30 in a cantilevered fashion. Further, referring to FIGS. 11-12 and 17, an end of the second slot 208 proximate or near the faceplate 34 comprises a radius to help distribute the stress concentrations experienced during the faceplate 34 bending. In the illustrated embodiment, the radius of the second slot 208 at the end near or proximate the face plate 34 is 0.15 inches. In other embodiments, the radius of the second slot 208 at the end near or proximate the faceplate 34 can be 0.05 to 0.8 inches. For example, in some embodiments, the radius of the second slot 208 at the end near or proximate the faceplate 34 can be 0.05 to 0.25 inches, 0.15 to 0.35 inches, 0.25 to 0.45 inches, 0.35 to 0.55 inches, 0.45 to 0.65 inches, or 0.55 to 0.8 inches.

It should be noted that the gap 112, 212 comprises a width, measured as the distance across the slot 108, 208. In the illustrated embodiments, each gap 112, 212 has a uniform width along the length of the respective slot 108, 208. However, in other embodiments, one or both gaps 112, 212 can have a variable width along the length of the respective slot 108, 208. For example, one or both gaps 112, 212 can have a tapered width (e.g., an increasing width along the length of the slot 108, 208 from the sole 30 towards the top rail 26, or a decreasing width along the length of the slot 108, 208 from the sole 30 towards the top rail 26) or a non-uniform width (e.g., the width can both increase and decrease along the length of the slot 108, 208 from the sole 30 towards the top rail 26).

Further, the width of the gap 112, 212 can range from approximately 0.02 inches to approximately 2.0 inches. In other embodiments the width of each gap 112, 212 can range from approximately 0.020 inches to approximately 0.120 inches, from approximately 0.040 inches to approximately 0.100 inches, 0.080 inches to approximately 0.100 inches, from approximately 0.080 inches to approximately 0.15 inches, from approximately 0.100 inches to approximately 0.35 inches, from approximately 0.20 inches to approximately 0.45 inches, from approximately 0.30 inches to approximately 0.55 inches, from approximately 0.40 inches to approximately 0.65 inches, from approximately 0.50 inches to approximately 0.75 inches, from approximately 0.60 inches to approximately 0.85 inches, from approximately 0.070 inches to approximately 0.95 inches, from approximately 0.080 inches to approximately 1.05 inches, from approximately 0.090 inches to approximately 1.15 inches, from approximately 1.00 inches to approximately 1.250 inches, from approximately 1.10 inches to approximately 1.35 inches, from approximately 1.20 inches to approximately 1.45 inches, from approximately 1.30 inches to approximately 1.55 inches, from approximately 1.4 inches to approximately 1.75 inches, from approximately 1.60 inches to approximately 1.85 inches, or from approximately 1.750 inches to approximately 2.0 inches. In many embodiments, the width of each gap 112, 212 can be greater than or equal to 0.040 inches. In addition, the gaps 112, 212 can have a width that is 0.020 inches, 0.030 inches, 0.040 inches, 0.050 inches, 0.060 inches, 0.070 inches, 0.080 inches, 0.090 inches, 0.100 inches, 0.110 inches, 0.120 inches, 0.150 inches, 0.170 inches, 0.200 inches, 0.250 inches, 0.300 inches, 0.350 inches, 0.400 inches, 0.450 inches, 0.500 inches, 0.550 inches, 0.600 inches, 0.650 inches, 0.700 inches, 0.750 inches, 0.800 inches, 0.850 inches, 0.900 inches, 1.000 inches, 1.100 inches, 1.120 inches, 1.130 inches, 1.140 inches, 1.150 inches, 1.160 inches, 1.170 inches, 1.180 inches, 1.190 inches, or 2.000 inches. In various embodiments, the gaps 104, 112 can have the same width or different widths.

Bending of the Faceplate

During impact with a golf ball, the faceplate of a golf club head comprising at least one slot extending through the top rail undergoes deflection. The faceplate 34 deflects in a travel direction generally towards the rear end 38, i.e., direction 84. Due to the at least on slot extending through the top rail, the faceplate 34 of the golf club head 10 is connected to the back 38 only by the sole 30. Thus, the faceplate 34 can be detached from the back 38 at the toe 18 by the first slot 100, 200, 300 and the faceplate 34 can be detached from the back 38 at the heel 22 by the second slot 108, 208. Since the faceplate 34 is connected to the back 38 only by the sole 30, the faceplate 34 is free to deflect or bend about the sole 30 at impact. Because the faceplate 34 is free to bend about the sole 30, the faceplate 34 can more uniformly deflect or bend about the sole 30 (with the sole 30 acting as a fulcrum). Bending about the sole 30 can be defined as cantilevered bending, while bending inward from the perimeter of the faceplate 34 at the point of impact with the golf ball is defined as drum style bending. Because the faceplate 34 is free to bend about the sole 30 (i.e. not restrained by the heel 22 or the toe 18), the cantilevered bending is increased, while the drum style bending is diminished. This can result in an increase in ball launch angle and a decrease in ball spin. The launch angle is increased because the increased cantilevered bending results in greater faceplate 34 deflection. The extra deflection in the faceplate 34 results in the ball reflecting off the faceplate 34 at a steeper angle than a ball reflecting off a faceplate having a standard bending profile (e.g. a faceplate on a golf club head not comprising the slots). Further, the ball spin is decreased because the extra deflection in the faceplate 34 creates a shift in CG throughout the impact, creating a dynamic CG which moves the CG closer to the faceplate 34 at the point the ball leaves the faceplate 34, thus decreasing the spin induced on the ball.

As discussed above, the cantilevered bending about the sole 30 is increased and the drum style bending at the center of the faceplate 34 is decreased. Because the majority of the bending occurs in a cantilevered manner about the sole 30 and not in a drum style-bending about the center of the faceplate 34, a large portion the bending stresses are removed from the faceplate 34. The stresses are instead focused at the sole 30 and the slots 100, 108, 200, 208, wherein the majority of the bending now occurs. Therefore, the club head 10 can comprise a thinner faceplate 34 than a club head 10 not comprising the slots 100, 108, 200, 208. The thinner faceplate 34 can result in a further increase in the faceplate 34 deflection, a decrease in faceplate 34 weight, while also increasing the ball speed after impact. Combining the high ball speed, the greater launch angle and the decrease in ball spin can result in a longer and more consistent ball trajectory distance.

Further, due to the cantilevered bending about the sole 30, the stress concentrations are moved from the faceplate 34 to the sole 30 and the slots 100, 108, 200, 208. The stresses in the faceplate 34 of a club head 10 comprising the slots 100, 200, 108, 208 can be reduced by as much as 25% when compared to a club head not having the slots 100, 200, 108, 208. For example, in some embodiments, the stress in the faceplate 34 of a golf club head 10 having the slots 100, 200, 108, 208 is reduced by 5%, 7.5%, 10%, 12.5%, 15%, 17.5%, 20%, 22.5%, or 25%. Because the stresses are lower in the faceplate 34, the thickness of the faceplate 34 of club head 10 comprising the slots 100, 200, 108, 208, measured as the distance from the front of the faceplate 34 to the rear surface of the faceplate 72, can be reduced compared to a club head without the slots 100, 200, 108, 208. For example, in some embodiments, the faceplate 34 of a golf club head 10 comprising the slots 100, 200, 108, 208 can be reduced to within the range of 0.040 inches to 0.1 inches. In the illustrated embodiment, the faceplate 34 thickness is 0.076 inches. In other embodiments, the faceplate 34 thickness can be 0.040 to 0.06 inches, 0.050 to 0.070 inches, or 0.080 to 0.100 inches. Reducing, the faceplate 34 thickness can result in an increased ball speed and as such an increased golf ball travel distance. Further, the reduced faceplate 34 thickness can result in additional weight savings and therefore, the discretionary weight can be added to other portions of the club head 10 improving the overall club head 10 CG and MOI. Because the stresses are distributed about the sole 30, the sole 30 can comprise a greater thickness or a reinforced material. In the illustrated embodiment, the sole 30 has a thickness of 0.0585 inches. In other embodiments, the thickness of the sole may range from 0.03 to 0.100 inches. For example, in some embodiments, the thickness of the sole 30 may vary from 0.03 to 0.05 inches, 0.04 to 0.06 inches, 0.05 to 0.07 inches, 0.06 to 0.08 inches, 0.07 to 0.09 inches, or 0.08 to 0.10 inches. In other embodiments, the sole 30 can comprise a cascading sole type structure similar to the cascading sole described in U.S. patent application Ser. No. 14/920,480.

The faceplate 34 deflects or bends until a portion, up to and including the entirety, of the gap 104, 204 of the first slot 100, 200 collapses. For example, with reference to FIG. 6, the faceplate 34 deflects until the interior surface 72 (shown in FIG. 5) of the faceplate 34 impacts (or comes into contact with) the body 14 at the toe 18. In other embodiments, a portion of the gap 104, 204 can partially or completely collapse. In yet other embodiments, the faceplate 34 can deflect or bend any suitable or predetermined amount. In other embodiments, the faceplate 34 can deflect or bend until contacting a support structure (e.g., a CTP insert positioned within the cavity 68, etc.). Once the faceplate 34 ceases to deflect or bend, the faceplate 34 rebounds to its respective pre-impact position (i.e., travels in a direction opposite the direction 84). This rebound generates the desired spring-like effect that can result in an increase in golf ball speed and an increase in golf ball travel distance.

Slots with Filler Material

Figure 14:
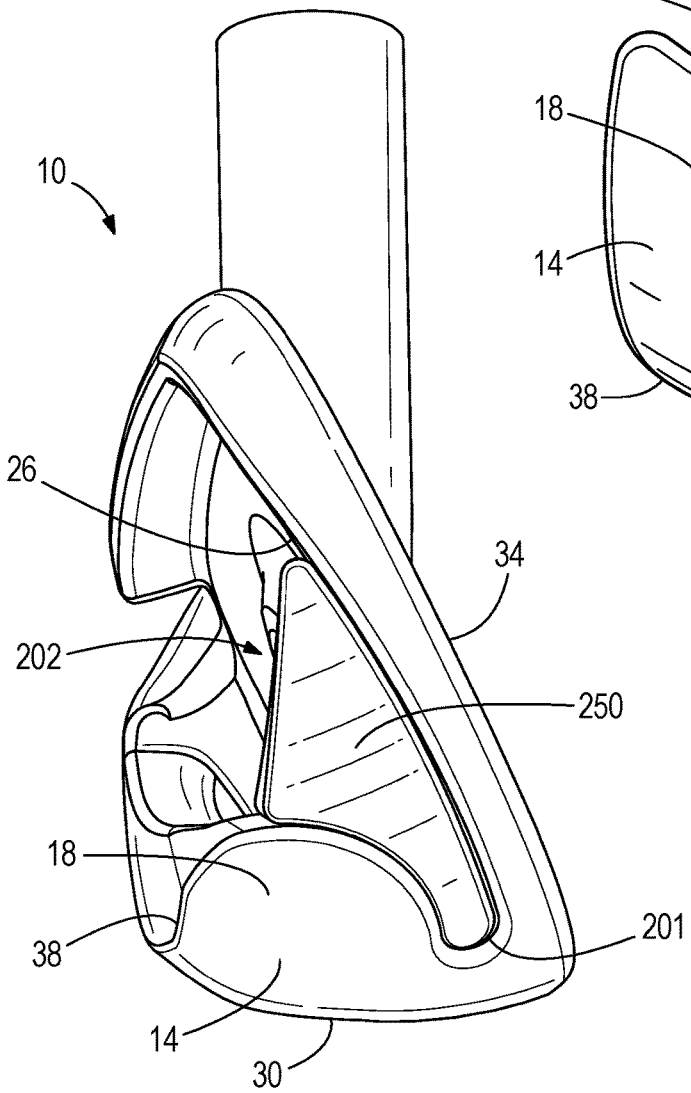
FIG. 14 is a toe side view of the first slot of FIG. 9 comprising a filler material.
Figure 15:
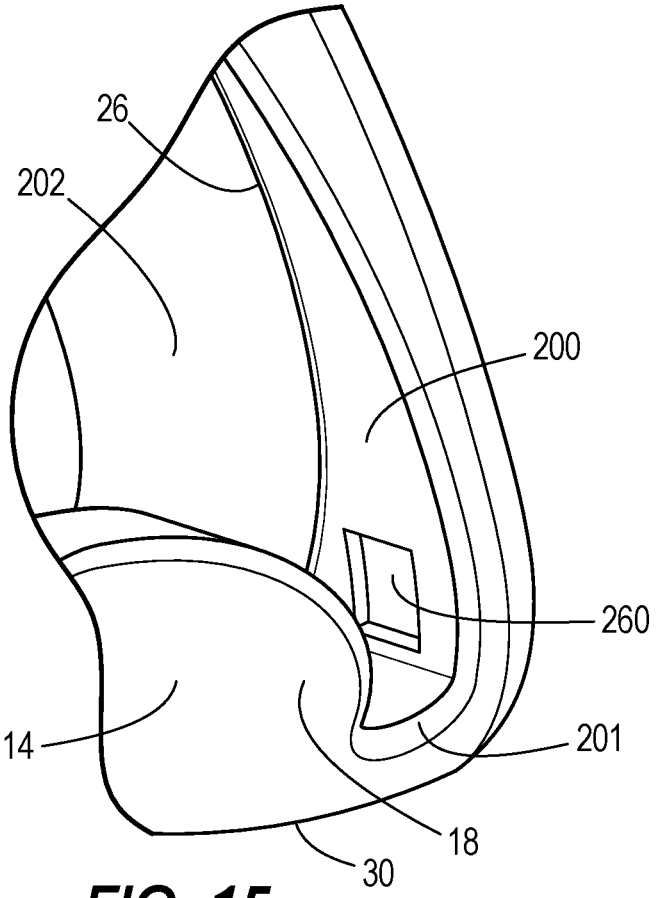
FIG. 15 is a rear perspective view of the first slot of FIG. 9 comprising a magnet.
Figure 16:
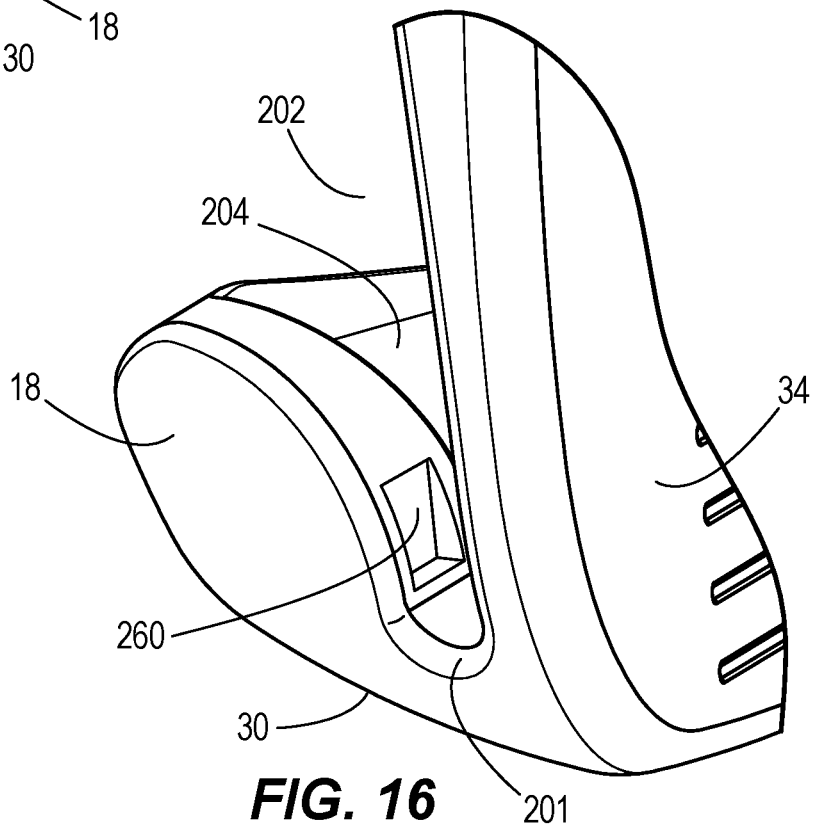
FIG. 16 is a front perspective view of the first slot of FIG. 9 comprising a magnet.

The golf club head comprising at least one slot extending through the top rail can further including material to damp or restrict the bending. For example, the golf club head can include a polymeric material, a composite material, a non-Newtonian material, a metal, a magnet or any other suitable material that can help dam or control the faceplate bending. In the aforementioned embodiments, each slot 100, 108, 200, 208 is illustrated as an open slot. In some embodiments, one or both slots 100, 108, 200, 208 or a portion thereof, can be filled. The slots 100, 108, 200, 208 can be filled with a polymer, a composite, a metal or a flexible material. For example, referring to FIG. 14, the slot 200 is illustrated with a polymer filling 250. In the illustrated embodiment, the polymer filling 250 entirely fills the gap 204. In other embodiments, the polymer filling 250 can partially fill the gap 204. In these or other embodiments, the filler material can restrict the faceplate 34 deflection. For example, the faceplate 34 can deflect or bend until contacting the filler material 250 positioned in one or both of the first and second slots 100, 108, 200, 208. Further, in some embodiments, referring to FIGS. 15 and 16, the slot 200 can comprise magnets 260. The magnets 260 can be configured to repel or attract each other. Further, in some embodiments, the magnets 260 can be correlated or polymagnets. In these or other embodiments, the magnets 260 can be configured to attract or repel each other at a certain distance. For example, the magnets 260 can attract each other prior to impact and then repel each other after the faceplate 34 has deformed a predetermined distance towards the rear end 38. The material can increase club head durability (e.g., to limit dirt or debris from building up in the slots 100, 108, 200, 208, or to limit corrosion within the slots 100, 108, 200, 208, etc.) or improve the aesthetics of the club head 10. In some embodiments, the filler material can be removable.

Method of Manufacturing Club Head Having Detached Faceplate

A method of manufacturing a club head 10 having the detached faceplate 34 is provided. The method includes providing the body 14 having the top rail 26, the sole 30, the faceplate 34, the hosel 44, and the cavity 68. The first slot 100 can be formed between the faceplate 34 and the body 14 at the toe 18, and the second slot 108 can be formed between the faceplate 34 and the body 14 at the heel 22. Stated another way, one or both of the slots 100, 108, 200, 208 can be created (or otherwise) formed by casting the club head 10 with one or both slots 100, 108, 200, 208 forging the club head 10 and then machining one or both slots 100, 108, 20, 208 (e.g., one or both slots 100, 108, 200, 208 can be cut into the club head 10 after forging of the club head), casting the club head 10 and then machining one or both slots 100, 108, 200, 208 (e.g., one or both slots 100, 108, 200, 208 can be cut into the club head 10 after casting of the club head), or a combination thereof.

The method of manufacturing the club head 10 described herein is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

EXAMPLE 1

Figure 18:
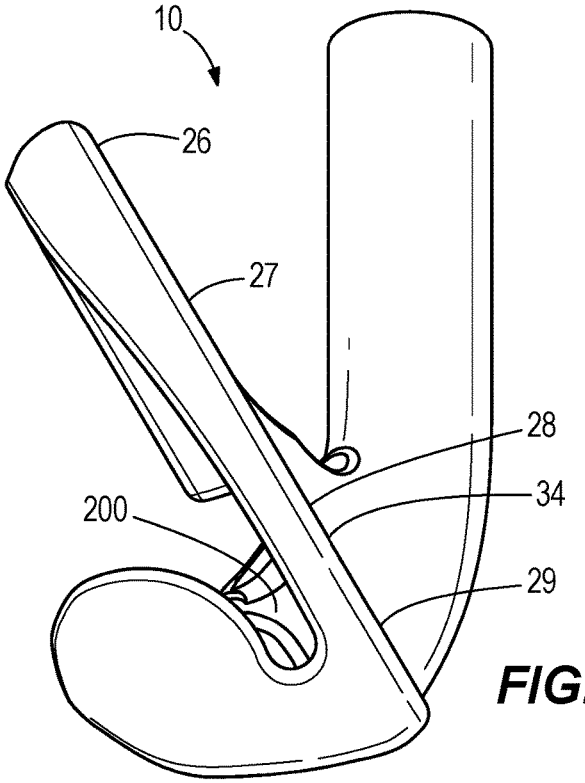
FIG. 18 is a toe side view of the golf club head comprising the first slot of FIG. 9.

Table 1 shows the experimental results for a golf club head 10 comprising the slots 200, 208 compared with a golf club head not having the slots 200, 208. As discussed above, the slot 200 extends through the top rail 26 into the toe 18 of the body 14, defining a gap 204 having a varying width. Further, the slot 208 extends entirely through the top rail 26 defining a gap 212 between the top rail 26 and the heel 22 of the body 14. To ensure accurate and reliable results of the two club heads described above, the tests were performed having the following controls (1) face thickness of 0.088 inches, (2) a club head speed of 100 mph, (3) formed of a 17-4 steel material, and (4) a 7-iron having a static loft angle of 30.5 degrees. As illustrated in FIG. 18, the deflection was measured at four points along the faceplate 34. Specifically, the deflection was measured at the top rail 26, a location above the face center 27, a location at the face center 28, a location below the face center 29.

TABLE 1

Club head with slots Vs. Club head without slots

| | Club Head with Slots | Club Head without Slots |
|---|---|---|
| Deflection Top Rail | .0528 inches | 0.0302 inches |
| Deflection above Face Center | 0.0451 | 0.0358 |
| Deflection at Face Center | 0.0354 | 0.0328 |
| Deflection Below Face Center | 0.0192 | 0.0195 |
| Launch Angle | 20.2° | 18.5° |
| Ball Spin | 7100 rpm | 7250 rpm |

As can be seen in the results above, the golf club head 10 comprising the slots 200, 208 experiences greater deflection rates than the club head without the slots. Specifically, the club head 10 comprising the slots 200, 208 experiences approximately 0.0226 inches (74.8%) more deflection at the top rail, approximately 0.0093 inches (26%) more deflection at a location above the face center, and approximately 0.0026 inches (7.9%) at the face center. It should also be noted that the launch angle is increased by approximately 1.7 (9.19%) degrees on the club head including slots, while the ball spin is reduced by approximately 150 rpm (2%).

EXAMPLE 2

Table 2 shows the experimental results for a golf club head 10 comprising the slots 200, 208 having a face thickness of 0.076 inches compared with a golf club head comprising the slots 200, 208 having a face thickness of 0.088 inches. To ensure accurate and reliable results of the two club heads described above, the tests were performed having the following controls (1) face thickness of 0.088 inches, (2) a club head speed of 100 mph, (3) formed of a 17-4 steel material, and (4) a 7-iron having a static loft angle of 30.5 degrees. Similar to the test of example 1, the deflection was measured at four points along the faceplate 34. Specifically, the deflection was measured at the top rail 26, a location above the face center 27, a location at the face center 28, a location below the face center 29.

| | Club Head with Slots - 0.076 inch Face Thickness | Club Head with Slots - 0.088 inch Face Thickness |
|---|---|---|
| Deflection Top Rail | .0620 inches | 0.0528 |
| Deflection above Face Center | 0.0560 | 0.0451 |
| Deflection at Face Center | 0.0445 | 0.0354 |
| Deflection Below Face Center | 0.0227 | 0.0192 |
| Launch Angle | 20.5° | 20.2° |
| Ball Spin | 7050 rpm | 7100 rpm |

As can be seen in the results above, the golf club head 10 comprising the slots 200, 208 and having a face thickness of 0.076 inches experiences greater deflection rates than the club head 10 comprising slot 200, 208 having a face thickness of 0.088 inches. Specifically, the club head 10 comprising the slots 200, 208 experiences approximately 0.0092 inches (17.42%) more deflection at the top rail, approximately 0.0109 inches (24%) more deflection at a location above the face center, and approximately 0.0091 inches (25%) at the face center. It should also be noted that the launch angle is increased by approximately 0.3 (1.48%) degrees on the club head including slots having a face thickness of 0.076 inches, while the ball spin is reduced by approximately 50 rpm (0.7%).

Clause 1. A golf club head comprising: a body including a faceplate having a strike surface, a toe end opposite a heel end, a back end opposite the faceplate, and a sole opposite a top rail, the faceplate connected to the sole and configured to pivot about the sole.

Clause 2. The golf club head of clause 1, wherein the faceplate is only connected to the sole.

Clause 3. The golf club head of clause 1, wherein the faceplate is detached from the body by a slot.

Clause 4. The golf club head of clause 3, wherein the slot extends through the top rail towards the sole.

Clause 5. The golf club head of clause 4, wherein the slot is positioned between the faceplate and the heel end.

Clause 6. The golf club head of clause 4, wherein the slot is positioned on a heel end side of the strike surface.

Clause 7. The golf club head of clause 3, wherein the slot extends through the toe end of the body.

Clause 8. The golf club head of clause 7, wherein the slot is positioned between the faceplate and the back end.

Clause 9. The golf club head of clause 7, wherein the body includes a cavity positioned on a back end side of the faceplate, the slot extends into the cavity.

Clause 10. The golf club head of clause 7, wherein the faceplate is spaced from the back end by the slot.

Clause 11. The golf club head of clause 7, wherein the slot separates the faceplate from the back end, the faceplate being connected to the sole at the toe end.

Clause 12. The club head of clause 3, wherein the slot has a width that is in the range of 0.040 inches to 0.100 inches.

Clause 13. The club head of clause 3, wherein the slot has a width that is greater than or equal to 0.040 inches.

Clause 14. The club head of clause 3, wherein the slot has a uniform width.

Clause 15. The club head of clause 3, wherein the slot has a variable width.

Clause 16. A golf club head comprising: a body including a faceplate having a strike surface, a toe end opposite a heel end, a back end opposite the faceplate, a sole opposite a top rail, and a plurality of slots extending through the body, at least one slot extending through the body at the toe end, the slot spacing the faceplate from the back end at the toe end of the body.

Clause 17. The golf club head of clause 16, wherein the plurality of slots partially detach the faceplate from the body such that the faceplate is connected to the body only at the sole.

Clause 18. The golf club head of clause 16, wherein the faceplate is configured to bend about the sole.

Clause 19. The golf club head of clause 16, wherein the plurality of slots each have a width that is in the range of 0.040 inches to 0.100 inches.

Clause 20. The golf club head of clause 16, wherein the plurality of slots each have a width that is greater than or equal to 0.040 inches.

Clause 21. The golf club head of clause 16, wherein the plurality of slots each have a width that is the same.

Clause 22. The golf club head of clause 16, wherein the plurality of slots each have a width that is different.

Clause 23. The golf club head of clause 16, wherein the at least one slot is a first slot, and further comprising a second slot extending through the top rail towards the sole.

Clause 24. A golf club head comprising: a body including a club face having a faceplate, a toe end opposite a heel end, a back end opposite the faceplate, a sole opposite a top rail, and a plurality of slots extending through the body, at least one slot extending through the top rail and a portion of the club face towards the sole.

Clause 25. The golf club head of clause 24, wherein the plurality of slots partially detach the faceplate from the body such that the faceplate is only connected to the body at the sole.

Clause 26. The golf club head of clause 24, wherein the faceplate is configured to bend about the sole.

Clause 27. The golf club head of clause 24, wherein the plurality of slots each have a width that is in the range of 0.040 inches to 0.100 inches.

Clause 28. The golf club head of clause 24, wherein the plurality of slots each have a width that is greater than or equal to 0.040 inches.

Clause 29. The golf club head of clause 24, wherein the plurality of slots each have a width that is the same.

Clause 30. The golf club head of clause 24, wherein the plurality of slots each have a width that is different.

Clause 31. The golf club head of clause 24, wherein the at least one slot is a first slot, and further comprising a second slot spaced from the first slot and extending through the top rail and a portion of the clubface towards the sole.

Various features and advantages of the disclosure are set forth in the following claims.

The invention claimed is:

1. A golf club head comprising:

a body including:

a faceplate having a strike surface;

a toe end opposite a heel end;

a back end opposite the faceplate;

a sole opposite a top rail;

a first slot extending entirely through the toe end of the body, the first slot having a first end proximate the sole, wherein the first end of the first slot is circular, wherein the first slot defines a gap which separates the faceplate from the back end, wherein the width of the gap increases in a direction from the sole towards the top rail; and a second slot extending through the top rail, having an end proximate the face plate, the end comprising a radius;

wherein the first slot separates the faceplate from the back end such that only the sole connects the faceplate and back end at the toe end of the body; and wherein the toe end is substantially normal to the strike surface.

2. The golf club head of claim 1, wherein at least a portion of the first slot or the second slot is filled with a filler material.

3. The golf club head of claim 1, wherein the first end of the first slot comprises a radius, wherein the radius of the first end of the first slot and the radius of the end of the second slot is within 0.05 to 0.8 inches.

4. The golf club head of claim 1, wherein the gap has a width defined as the distance across the first slot, and wherein the width is within the range of 0.2 to 2 inches.

5. The golf club head of claim 4, wherein the width of the gap increases in a linear manner towards the top rail.

6. The golf club head of claim 4, wherein the width of the gap increases in a curvilinear manner.

7. The golf club head of claim 1, wherein the first slot extends into 50% of a height of the toe end of the body.

8. The golf club head of claim 1, wherein the first slot extends into 70% of a height of the toe end of the body.

9. The golf club head of claim 1, wherein the first slot extends into 100% of a height of the toe end of the body.

10. The golf club head of claim 1, wherein the second slot defines a gap which separates the faceplate from the heel end of the body.

11. The club head of claim 1, wherein the gap has a width defined as the distance across the second slot, and wherein the width is within the range of 0.2 to 2 inches.

12. The club head of claim 1, wherein the second slot extends through the heel into a hosel portion of the body.

13. The club head of claim 1, wherein the faceplate is separated from the back end of the body by the first slot on the toe end and the second slot on the heel end.

14. A golf club head comprising:

a body including:

a faceplate having a strike surface;

a toe end opposite a heel end;

a back end opposite the faceplate;

a sole opposite a top rail;

a first slot extending entirely through the toe end of the body, the first slot having a first end proximate the sole, wherein the first end of the first slot is circular, wherein the first slot defines a gap which separates the faceplate from the back end; and a second slot extending through the top rail, having an end proximate the face plate, the end comprising a radius, wherein at least a portion of the first slot or the second slot is filled with a filler material;

wherein the first slot separates the faceplate from the back end such that only the sole connects the faceplate and back end at the toe end of the body; and wherein the toe end is substantially normal to the strike surface.

15. The golf club head of claim 14, wherein the first end of the first slot comprises a radius, wherein the radius of the first end of the first slot and the radius of the end of the second slot is within 0.05 to 0.8 inches.

16. The golf club head of claim 14, wherein the gap has a width defined as the distance across the first slot, and wherein the width is within the range of 0.2 to 2 inches.

17. The golf club head of claim 14, wherein the second slot defines a gap which separates the top rail from the heel end of the body.

18. The golf club head of claim 17, wherein the gap has a width defined as the distance across the second slot, and wherein the width is within the range of 0.2 to 2 inches.

19. The golf club head of claim 14, wherein the faceplate is separated from the back end of the body by the first slot on the toe end and the second slot on the heel end.

* * * * *